US012509876B2

(12) United States Patent
McCorriston

(10) Patent No.: US 12,509,876 B2
(45) Date of Patent: Dec. 30, 2025

(54) FRAMING BRACKETS AND SYSTEMS FOR SHIPPING CONTAINER INTERIOR

(71) Applicant: Safe Box Steel Structures Inc., Saskatoon (CA)

(72) Inventor: Channing McCorriston, Saskatoon (CA)

(73) Assignee: Safe Box Steel Structures Inc., Saskatoon (CA)

( * ) Notice: Subject to any disclaimer, the term of this patent is extended or adjusted under 35 U.S.C. 154(b) by 269 days.

(21) Appl. No.: 18/472,894

(22) Filed: Sep. 22, 2023

(65) Prior Publication Data

US 2025/0101734 A1 Mar. 27, 2025

(51) Int. Cl.
*E04B 1/348* (2006.01)

(52) U.S. Cl.
CPC ..... *E04B 1/3483* (2013.01)

(58) Field of Classification Search
CPC ..... E04B 1/3483
USPC ..... 52/79.9; 248/547, 300
See application file for complete search history.

(56) References Cited

U.S. PATENT DOCUMENTS 3,945,741 A * 3/1976 Wendt ..... E04B 1/5818 403/231
4,920,725 A * 5/1990 Gore ..... F16B 9/05 52/704
5,564,248 A * 10/1996 Callies ..... F16B 9/052 52/715
6,523,321 B1 * 2/2003 Leek ..... E04B 1/2612 52/289
6,560,943 B1 * 5/2003 Leek ..... E04B 7/045 52/715
8,677,718 B2 * 3/2014 Marshall ..... E04D 3/3608 52/713
8,720,129 B2 * 5/2014 Sias ..... E04G 21/142 52/125.2
11,732,524 B2 * 8/2023 Gordon ..... E04F 21/0015 52/213
2007/0044421 A1 * 3/2007 Nguyen ..... E04B 7/063 52/698

* cited by examiner

*Primary Examiner* — Paola Agudelo
(74) *Attorney, Agent, or Firm* — Spencer Fane, LLP

(57) ABSTRACT

A bracket, framing system, and kit of parts for use in supporting framing members for framing an interior space of a shipping container, the shipping container having walls with corrugation recesses and hollow tubing extending along upper surfaces of the walls, the bracket having a vertical surface to engage with an inward-facing surface of the hollow tubing and a horizontal surface adjacent the vertical surface to engage with a downward-facing surface of the hollow tubing while not engaging any corrugation recess, such that either or both of the vertical surface and the horizontal surface may be secured to the hollow tubing at any point along the hollow tubing. Upon installation, the bracket defines the interior ceiling and side wall planes, allowing for insulation and wiring concealment.

30 Claims, 17 Drawing Sheets

FIG. 15A
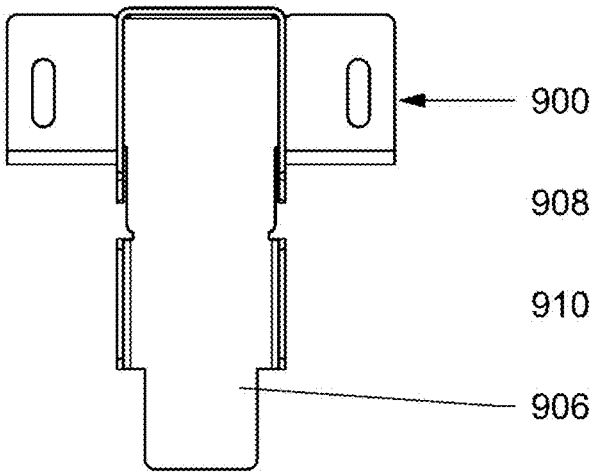
FIG. 15B
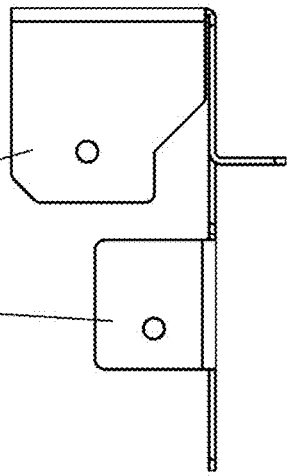
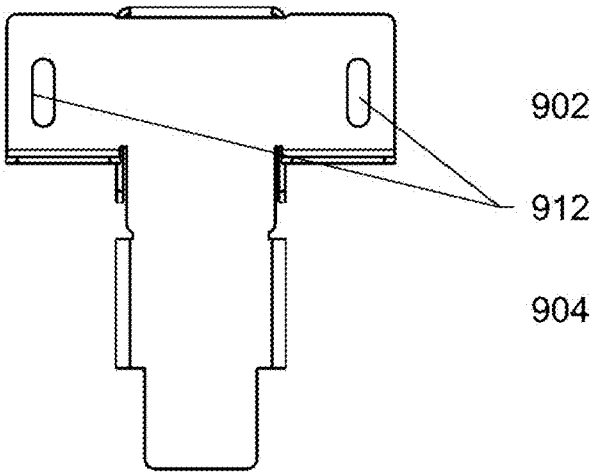
FIG. 15C
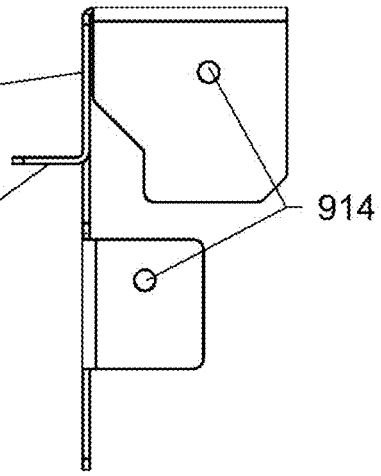
FIG. 15D

FIG. 15E
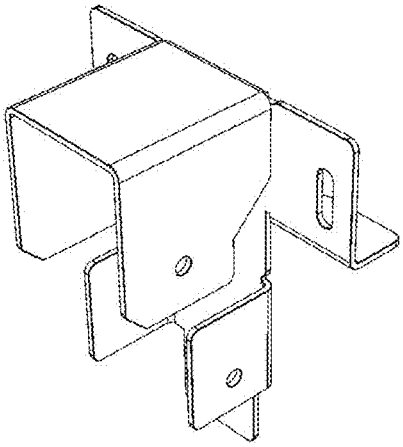
FIG. 15F
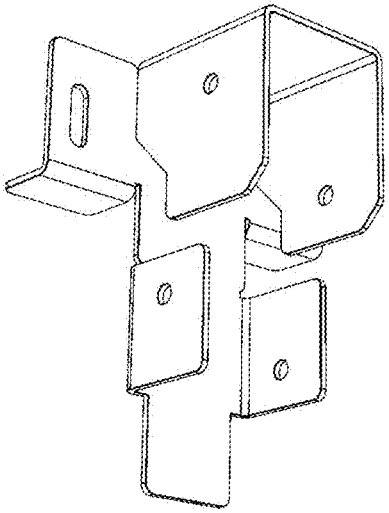
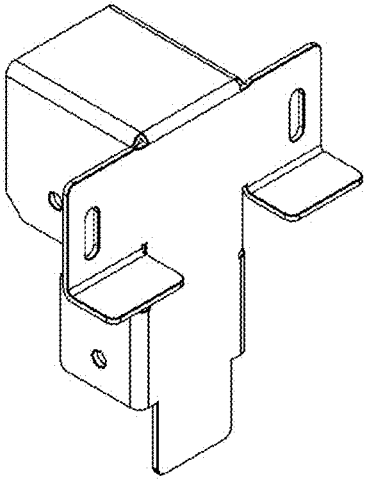
FIG. 15G

FRAMING BRACKETS AND SYSTEMS FOR SHIPPING CONTAINER INTERIOR

TECHNICAL FIELD OF THE INVENTION

The present invention pertains generally to the field of shipping container modifications, and more particularly to a method and system for interior framing and insulation of shipping containers.

BACKGROUND OF THE INVENTION

Shipping containers, while initially designed for transport and storage, have increasingly been used in recent years for various alternative applications. For example, these containers are highly robust, easily transportable, and provide a compact, predefined space, making them a popular choice for innovative architecture, ranging from small homes to commercial/industrial spaces.

However, when it comes to modifying shipping containers for human habitation or other such purposes, several challenges arise. One key aspect of these modifications involves interior framing such as walls and ceiling. The framing within shipping containers is fundamentally non-structural, instead serving three primary purposes: to conceal electrical wiring, to create room for insulation, and to convert the corrugated steel walls into a smooth surface suitable for interior wall coverings.

In conventional framing methods for shipping container interiors, the process is "bottom-up" starting with flooring and constructing walls and finally the ceiling, which requires a considerable amount of planning, manual labor, and experience. Even then, it often involves a degree of guesswork due to the uniqueness of each container's dimensions and features. The framing needs to be done without compromising the inherent sealed building envelope of the container, which requires careful planning and execution, and the envelope is often compromised by screws or other securing means puncturing the corrugated walls.

Another significant challenge with traditional framing methods is that they often result in direct contact between the framing members and the outer walls of the container. This can lead to thermal bridging-a process whereby energy is transferred directly from the interior to the exterior of the structure or vice versa. Thermal bridging not only results in energy loss but can also create conditions conducive to condensation, which can lead to issues with mold and moisture and, in the long term, corrosion.

Shipping containers meeting the International Organization for Standardization's specifications (ISO shipping containers) have a top hollow tubing capping the side wall corrugations. It is therefore possible to attach internal framing members such as brackets to this tubing without puncturing external walls and compromising the container envelope. In one such prior art bracket invented by the present inventor, and as illustrated in FIGS. 1A, 1B and 1C, a bracket 1 comprises a mounting member 2, an extension member 3, and a framing member engagement member 4. The mounting member 2 is sized and configured to be pressed into a corrugation in the shipping container wall and up against the bottom surface of the top hollow tubing, with screws passing through the holes 5 into the top hollow tubing to secure the bracket 1 in position. The framing member engagement member 4 is located spaced from the shipping container wall by means of the extension member 3. However, as will be clear, the requirement to secure such brackets 1 into corrugations results in adjacent bracket placements being restricted to distances dictated by the corrugation arrangement/spacing. Due to this, the user cannot customize distances between brackets which can present undesirable outcomes depending on the framing needs.

SUMMARY OF THE INVENTION

According to a first broad aspect of the present invention, there is provided a bracket for use in supporting framing members for framing an interior space of a shipping container, the shipping container comprising walls with a plurality of corrugation recesses and hollow tubing extending along upper surfaces of the walls, the bracket comprising:

- a vertical engagement surface configured for engagement with an inward-facing surface of the hollow tubing;
- a horizontal engagement surface adjacent the vertical engagement surface and configured for engagement with a downward-facing surface of the hollow tubing and non-engagement with a corrugation recess of the plurality of corrugation recesses; and
- either or both of the vertical engagement surface and the horizontal engagement surface configured for securing to the hollow tubing at any point along the hollow tubing.

In some exemplary embodiments of the first broad aspect, the bracket further comprises a horizontal extension configured to extend inwardly into the interior space to space the framing members from the walls and/or a vertical extension extending downwardly for providing an inwardly-facing surface for mounting one of the framing members thereto.

In some exemplary embodiments, either or both of the vertical engagement surface and the horizontal engagement surface comprise at least one aperture for passage therethrough of securing means to secure the bracket to the hollow tubing. The securing means are preferably of a length sufficient to pass into an interior of the hollow tubing but insufficient to pass completely through the hollow tubing, thereby helping to preserve shipping container envelope integrity. Other methods of securing the bracket to the hollow tubing will be known to those skilled in the art, such as for one non-limiting example adhesive glue or tape.

Where the bracket comprises a horizontal extension, the horizontal extension may comprise at least one aperture for securing one of the framing members thereto. Where the bracket comprises a vertical extension, the vertical extension may comprise at least one aperture for securing one of the framing members thereto.

The horizontal engagement surface is preferably composed of at least two alignment tabs. Some exemplary embodiments may instead comprise a single alignment tab.

Some exemplary embodiments of the first aspect comprise a wood stud support member configured to receive an end of a wood stud therein.

The bracket is preferably composed of a material selected from the group consisting of steel, aluminum, and plastic, although other suitable materials will be known to those of skill in the art such as for one non-limiting example composite material.

According to a second broad aspect of the present invention, there is provided a system for framing an interior space of a shipping container, the shipping container comprising walls with a plurality of corrugation recesses and hollow tubing extending along upper surfaces of the walls, the system comprising:

- at least two brackets, each of the brackets comprising:
  - a vertical engagement surface configured for engagement with an inward-facing surface of the hollow tubing;

a horizontal engagement surface adjacent the vertical engagement surface and configured for engagement with a downward-facing surface of the hollow tubing and non-engagement with a corrugation recess of the plurality of corrugation recesses; and either or both of the vertical engagement surface and the horizontal engagement surface configured for securing to the hollow tubing at any point along the hollow tubing, such that the at least two brackets are in spaced-apart relation along the hollow tubing; and a framing member engaged with each of the at least two brackets.

In some exemplary embodiments, at least one of the at least two brackets further comprises a horizontal extension configured to extend inwardly into the interior space to space the framing member from the walls.

In some exemplary embodiments, at least one of the at least two brackets further comprises a vertical extension extending downwardly for providing an inwardly-facing surface for mounting the framing member thereto.

The vertical engagement surface and/or the horizontal engagement surface may comprise at least one aperture for passage therethrough of securing means to secure the bracket to the hollow tubing. Preferably, the securing means are of a length sufficient to pass into an interior of the hollow tubing but insufficient to pass completely through the hollow tubing.

Where the brackets comprise a horizontal extension, the horizontal extension preferably comprises at least one aperture for securing the framing member thereto. Where the brackets comprise a vertical extension, the vertical extension preferably comprises at least one aperture for securing the framing member thereto.

Exemplary horizontal engagement surfaces are preferably but not necessarily composed of at least two alignment tabs.

In some exemplary embodiments, at least one of the at least two brackets further comprises a wood stud support member configured to receive an end of a wood stud therein.

The brackets may be composed of a material selected from the group consisting of steel, aluminum, and plastic, but other suitable materials will be known to those skilled in the art.

According to a third broad aspect of the present invention, there is provided a kit of parts for framing an interior space of a shipping container, the shipping container comprising walls with a plurality of corrugation recesses and hollow tubing extending along upper surfaces of the walls, the kit of parts comprising:

at least two brackets, each of the brackets comprising:

a vertical engagement surface configured for engagement with an inward-facing surface of the hollow tubing;

a horizontal engagement surface adjacent the vertical engagement surface and configured for engagement with a downward-facing surface of the hollow tubing and non-engagement with a corrugation recess of the plurality of corrugation recesses; and either or both of the vertical engagement surface and the horizontal engagement surface configured for securing to the hollow tubing at any point along the hollow tubing, such that the at least two brackets are in spaced-apart relation along the hollow tubing; and a framing member configured for engagement with each of the at least two brackets.

In some exemplary embodiments, at least one of the at least two brackets further comprises a horizontal extension configured to extend inwardly into the interior space to space the framing member from the walls. In some exemplary embodiments, at least one of the at least two brackets further comprises a vertical extension extending downwardly for providing an inwardly-facing surface for mounting the framing member thereto.

Either or both of the vertical engagement surface and the horizontal engagement surface may comprise at least one aperture for passage therethrough of securing means to secure the bracket to the hollow tubing. Preferably, the securing means are of a length sufficient to pass into an interior of the hollow tubing but insufficient to pass completely through the hollow tubing.

Where the kit of parts includes a bracket with a horizontal extension, the horizontal extension may comprise at least one aperture for securing the framing member thereto. Where the kit of parts includes a bracket with a vertical extension, the vertical extension may comprise at least one aperture for securing the framing member thereto.

The horizontal engagement surface may be, but is not necessarily, composed of at least two alignment tabs.

The brackets may further comprise a wood stud support member configured to receive an end of a wood stud therein.

The brackets are preferably but not necessarily composed of a material selected from the group consisting of steel, aluminum, and plastic.

A detailed description of exemplary embodiments of the present invention is given in the following. It is to be understood, however, that the invention is not to be construed as being limited to these embodiments. The exemplary embodiments are directed to particular applications of the present invention, while it will be clear to those skilled in the art that the present invention has applicability beyond the exemplary embodiments set forth herein.

BRIEF DESCRIPTION OF THE DRAWINGS

In the accompanying drawings, which illustrate exemplary embodiments of the present invention:

FIG. 15A is a front elevation view of an exemplary embodiment of a wood stud bracket.

FIG. 15B is a right side elevation view of the embodiment of FIG. 15A.

FIG. 15C is a rear elevation view of the embodiment of FIG. 15A.

FIG. 15D is a left side elevation view of the embodiment of FIG. 15A.

FIGS. 15E, 15F, and 15G are perspective views of the embodiment of FIG. 15A.

Figure 1A:
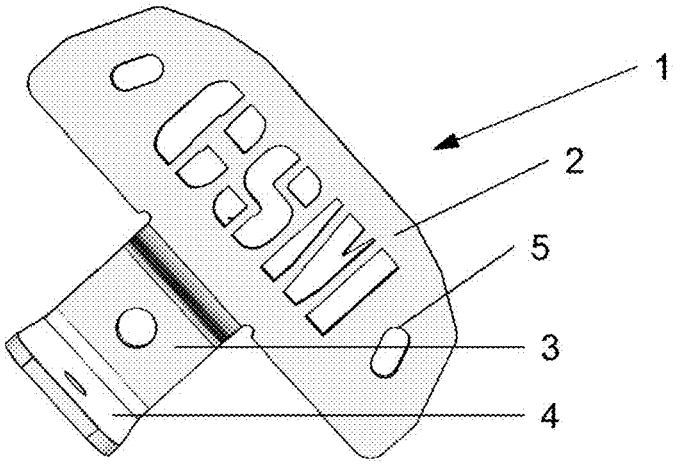
FIG. 1A PRIOR ART
FIGS. 1A, 1B and 1C are bottom and top perspective views of a prior art bracket.
Figure 1B:
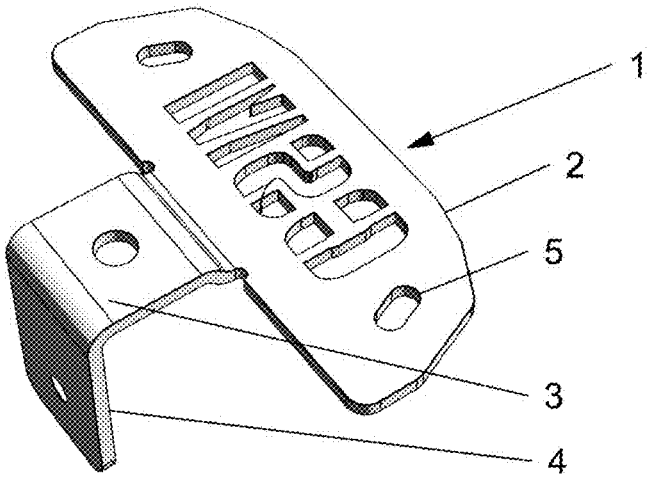
FIG. 1B PRIOR ART
Figure 1C:
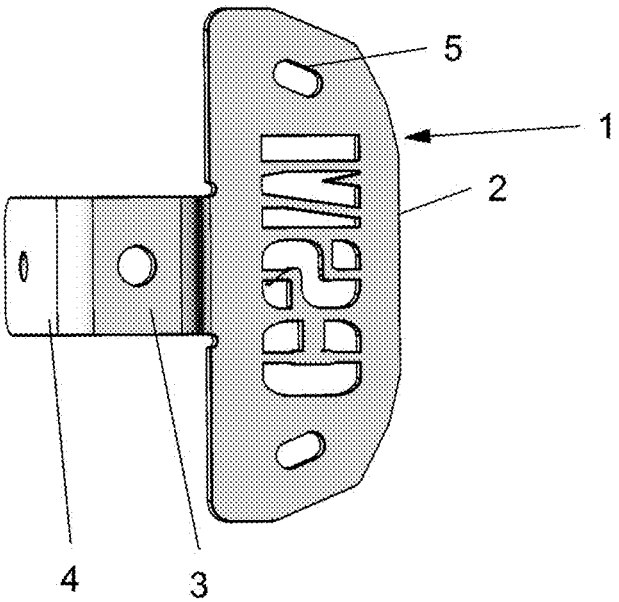
FIG. 1C PRIOR ART

Exemplary embodiments will now be described with reference to the accompanying drawings.

DETAILED DESCRIPTION OF EXEMPLARY EMBODIMENTS

Throughout the following description, specific details are set forth in order to provide a more thorough understanding to persons skilled in the art. However, well known elements may not have been shown or described in detail to avoid unnecessarily obscuring the disclosure. The following description of examples of the invention is not intended to be exhaustive or to limit the invention to the precise form of any exemplary embodiment. Accordingly, the description and drawings are to be regarded in an illustrative, rather than a restrictive, sense. The following detailed description refers to the accompanying drawings. The same reference numbers in different drawings may identify the same or similar elements.

The present invention offers an innovative solution to the challenges associated with traditional framing methods used in shipping container modification. The present invention utilizes a top-down method of framing, diverging from the conventional approach of working from the floor up.

Brackets according to the present invention are designed to mount on the top hollow tubing found on ISO shipping containers, with securing means such as screws occupying the hollow section and not penetrating the building envelope. This feature helps ensure that the container's inherent structural integrity and sealed envelope remains uncompromised, thereby preserving its robustness.

Once mounted, the bracket defines the interior ceiling and wall planes through a connecting top track or top plate in some exemplary embodiments, effectively laying the groundwork for further modification steps such as wiring concealment, insulation installation, and interior wall covering. In this way, embodiments according to the present invention may reduce guesswork, enhance efficiency, and significantly simplify the process of interior framing within shipping containers.

Furthermore, some embodiments may include slotted holes to accommodate potential variations in the installation process, such as drill bit walking.

Some exemplary embodiments may play a role in insulation and thermal bridging prevention if required. By keeping the framing members away from the outer walls of the shipping container, brackets according to the present invention may allow room for certain insulation media such as spray foam to act as a gap between the container walls and the framing members. This layer of insulation may help prevent thermal bridging, reducing energy loss and mitigating potential issues with condensation and corrosion.

Some exemplary systems may further include a corner casting cover, which defines the end wall plane and allows a layer of vapor barrier on the end wall corner castings. This feature may enhance the thermal efficiency of the modified container and contribute to the overall comfort and safety of the resulting living or working space.

While some embodiments are composed of aluminum due to its ease of processing, other embodiments may be composed of injection-molded plastic or composite materials. Such materials, especially when fire-resistant, could further reduce thermal bridging and enhance the safety of the structure.

According to some embodiment of the present invention, brackets have been specifically designed for use in the construction of modified shipping containers. The brackets may be fabricated from aluminum. The reason behind choosing aluminum is due to its lightweight nature, durability, and ease of processing. Aluminum can be conveniently processed according to standard sheet metal bending rules, which provides the necessary flexibility to obtain the desired shape of the brackets.

Exemplary aluminum brackets may be produced through a process that involves multiple stages. The initial stage involves cutting the aluminum sheet into the desired dimensions. The cut sheet is then bent according to specific angles and measurements that conform to the predefined shape of the brackets. This is done using standard sheet metal bending techniques, ensuring precision and consistency across multiple production runs.

The final shape of the bracket is engineered to interface seamlessly with the steel studs commonly used in shipping container modifications. The design and dimensions of the bracket allow it to firmly hold the track, providing stability, rigidity, and added strength to the overall structure of the modified shipping container.

The use of aluminum, besides the reasons stated above, also helps reduce thermal bridging, which is a common issue in metal structures. Thermal bridging can significantly affect the temperature regulation within the shipping container, making aluminum a beneficial choice in certain applications of exemplary embodiments of the present invention.

In some embodiments, the brackets may be fabricated using alternative materials such as injection-molded plastic or composite materials. The choice of these materials may be influenced by several factors. One of the primary considerations is the further reduction of thermal bridging. Injection-molded plastic or composite materials are known to be excellent thermal insulators, thereby significantly enhancing the energy efficiency of the modified shipping container.

Moreover, these materials may be made to incorporate fire-resistant properties. Fire resistance is a critical safety factor in construction materials, and thus, the incorporation of these properties would significantly improve the safety of the modified shipping container.

The present invention relates to brackets particularly designed for installation on the top hollow tubing that caps the side wall corrugations in ISO shipping containers.

Exemplary brackets comprise a top portion specifically designed to facilitate secure mounting on the surface of the top tubing of the ISO shipping container. The said top portion may be designed to be secured by one or more fasteners. The fasteners can be of any suitable type known in the art, including but not limited to, bolts, screws, rivets, adhesive, or any other type of mechanical fasteners that are used to connect or fasten things together.

In some embodiments, brackets also feature tabs that project perpendicularly from the top portion of the bracket. These tabs are designed to hug the lower surface of the tubing. The tabs serve a dual purpose of providing additional support to the bracket while ensuring correct and intuitive installation.

The present invention leverages the presence of the hollow section of the tubing, in such a way that it helps ensure that securing means do not penetrate the building envelope. In this way, the container remains intact, and reducing the possibility of any damage or degradation of the container due to the installation of the present invention.

In some embodiments, the bracket is equipped with slotted holes. The slotted holes are designed to account for potential variations during the installation, such as drill bit walking or similar installation inaccuracies. The presence of the slotted holes increases the simplicity of the bracket's installation, enhancing its adaptability to variable conditions and increasing user-friendliness.

While brackets may be made from an aluminum material, other strong and durable materials may also be used such as plastic. The material choice will depend on factors such as the required strength, the environment in which the bracket will be used, the cost of the material, and the ease of manufacturing.

Some exemplary systems according to the present invention, whether pre-designed systems or a kit of parts for custom installations, consist of a set of components that are installed within the interior of the shipping container. Once installed, the system delineates clear guidelines for the positioning and installation of other internal elements, effectively acting as a preliminary blueprint for the design of the container's interior.

Exemplary brackets are rigid and durable and made from high-quality aluminum, designed to adhere to the inner surface of the shipping container. The brackets are configured to define the ceiling and sidewall planes, forming a clear frame within the container's interior. The configuration and positioning of these brackets assist in mapping out the overall layout of the internal space.

In addition to the brackets, exemplary systems also include corner casting covers. This feature helps define the end wall plane of the shipping container. Specifically, it covers the corner castings, which are the structural elements located at each corner of the container.

Notably, the corner casting cover allows for the application of a sufficient layer of spray foam on the end wall corner castings, ensuring adequate insulation for the container's interior. By doing so, it addresses the challenge of insulating these traditionally hard-to-reach areas that otherwise intrude into the shipping container interior space, enhancing the overall insulation and thermal regulation of the converted container.

Exemplary embodiments of the bracket system can be installed using standard installation methods common in the construction industry, and in such cases would not require any specialized tools or expertise. Furthermore, the system may be manufactured to be compatible with ISO shipping containers of various sizes, offering flexibility and adaptability in its use.

Once an exemplary bracket system is installed, it may provide a clear and intuitive guideline for the subsequent installation of other interior elements (such as the top track), electrical wiring, insulation, and wall coverings. These elements can be installed within the framework created by the brackets, thereby simplifying the entire conversion process of the shipping container.

The following is a detailed description of one embodiment of the present invention. It is intended to provide a comprehensive understanding of the bracket's structural and functional components, its installation process, and how it may contribute to insulation, thermal bridging reduction, and condensation mitigation.

Brackets according to exemplary embodiments are designed for application in shipping container modifications. Their primary purpose is to support framing members, effectively holding them away from the walls of the shipping container.

The bracket comprises a sturdy aluminum body (although other materials may be suitable, as noted above) having a planar base and a vertical arm extending perpendicularly on both ends of the base in an opposite direction. One of the vertical arms is configured to create the requisite space between the framing members and the shipping container's outer wall. A set of secure fastening means, such as screws, rivets or bolts or other fasteners, may be incorporated into the bracket design for attaching it to the container wall and to the framing member, or adhesive securing means may be used where suitable.

Another vertical arm of the bracket is designed to abut against the surface of the top tubing. The planar base, in turn, extends outwardly into the shipping container's interior space, serving as a mounting point for the framing members. The base and arm include a receiving means, such as pre-drilled holes, for fastening the framing member securely to the bracket. When installed, the bracket keeps the framing member in a parallel but spaced relationship to the shipping container wall, with a sufficient gap maintained consistently.

This bracket arrangement provides a designated cavity to allow an insulation medium or vapor barrier such as closed cell spray foam or any other suitable methods. The created gap allows for a uniform application of the vapor barrier, thereby insulating the shipping container's interior from its exterior and maintaining balance between effective insulation and interior space preservation.

The bracket, in conjunction with the vapor barrier, offers several advantages. It may reduce thermal bridging, a common issue in shipping container modifications, where the container's steel body can conduct heat in or out, compromising energy efficiency. By spacing the framing members away from the shipping container walls, direct contact, and hence, thermal bridging, is minimized.

Additionally, the vapor barrier mitigates potential condensation issues within the shipping container by forming a layer between the cold outer wall and the warmer interior air. This feature decreases the likelihood of corrosion and prolongs the life span of the shipping container modification.

In summary, the brackets as described herein may provide a simple yet effective solution for shipping container modifications, enabling enhanced insulation, reduced energy loss, and mitigated condensation and corrosion problems.

Figure 2:
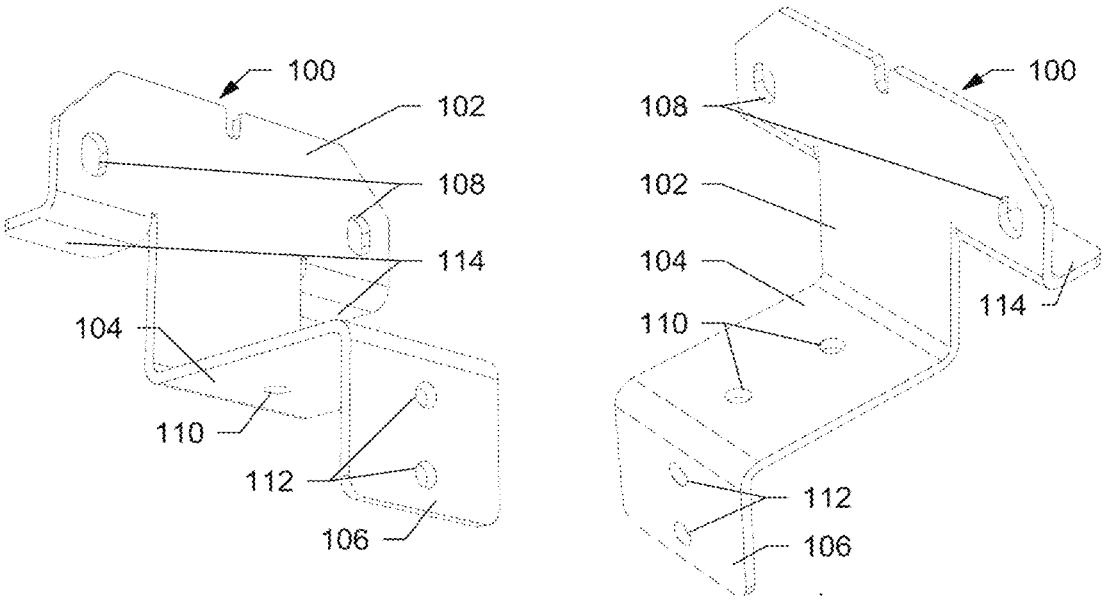
FIG. 2 is a front perspective view of a bracket according to an embodiment of the present invention.

Turning now to the figures illustrating exemplary embodiments of the present invention, FIG. 2 provides a front perspective view of a bracket 100, which comprises a thin flat substantially planar backing portion 102 adapted to be vertically positioned, having a pair of apertures 108 therein, a pair of rearward tabs 114 extending perpendicular rearwardly, said rearward-extending portions adapted to abut a lower side of top tubing. A thin, flat planer portion 104 extending perpendicularly outwardly and forwardly from a lower end of said tongue portion, having a pair of apertures 110 therein, and a thin flat substantially planar portion 106, extending perpendicular downward from said extension portion, having plurality of apertures 112 therein.

Figure 3A:
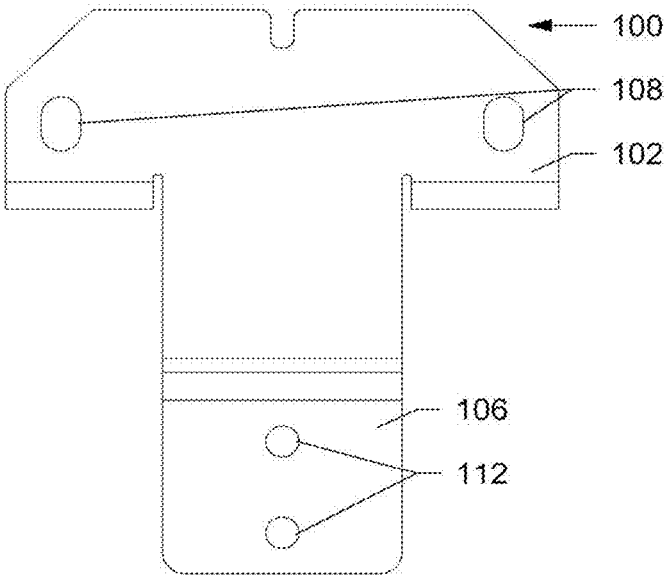
FIG. 3A is a front elevation view of the embodiment of FIG. 2.
Figure 3B:
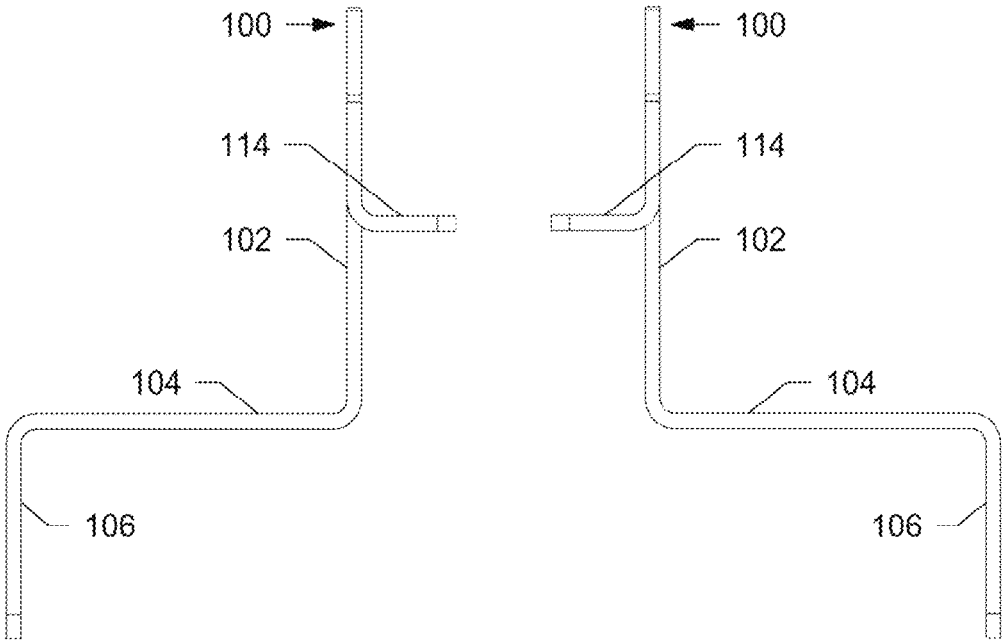
FIG. 3B is a left side elevation view and a right side elevation view of the embodiment of FIG. 2.
Figure 3C:
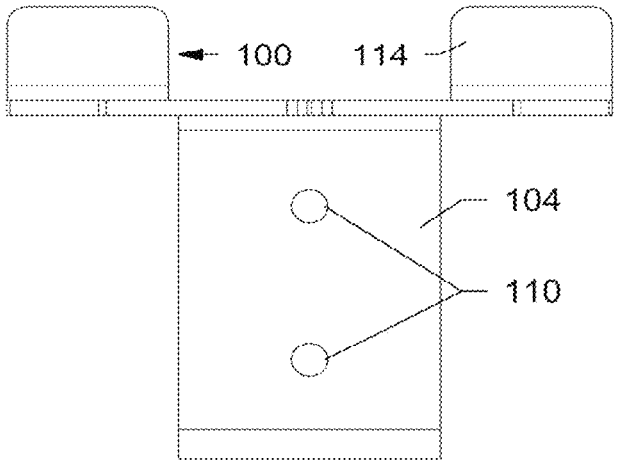
FIG. 3C is a top plan view of the embodiment of FIG. 2.

FIG. 3A provides a front view of the bracket 100. The vertical portion 102 is mounted using holes 108 via bolts, rivets or screws or other suitable fasteners in a laterally spaced manner. FIG. 3B provides the left side view and right side views of the bracket 100 including tabs 114. FIG. 3C provides the top view of the bracket 100 which shows a thin planar portion 104 with apertures 110 therein.

Figure 4A:
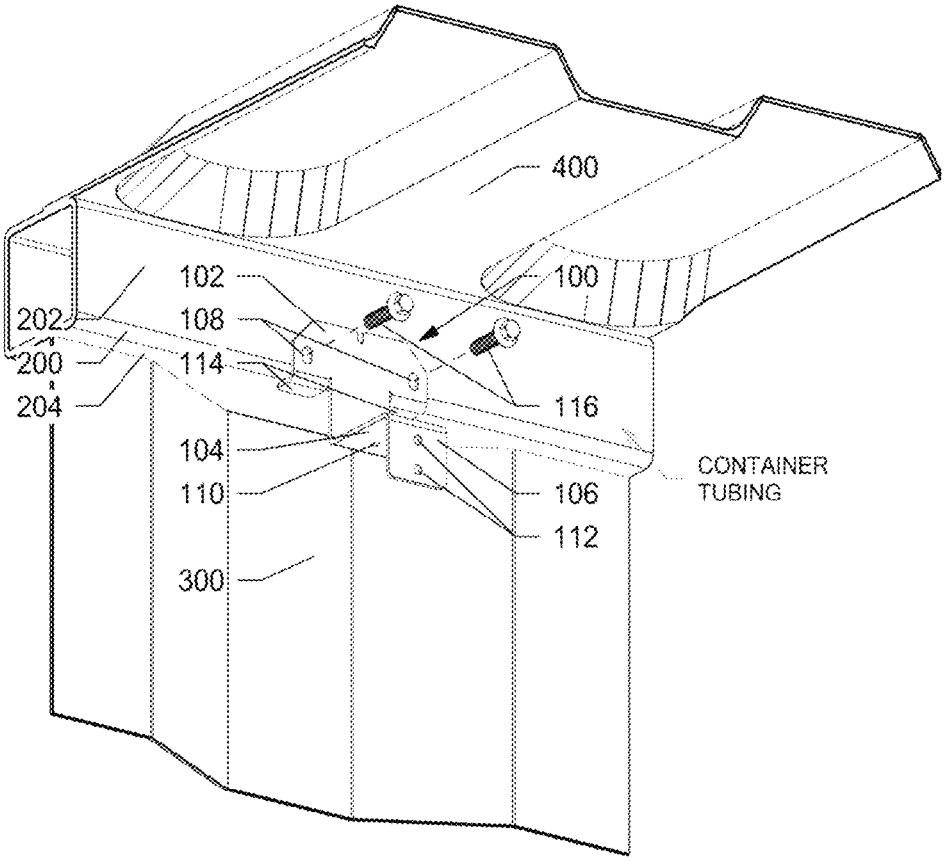
FIG. 4A is a perspective view of the mounting position of an exemplary bracket.
Figure 4B:
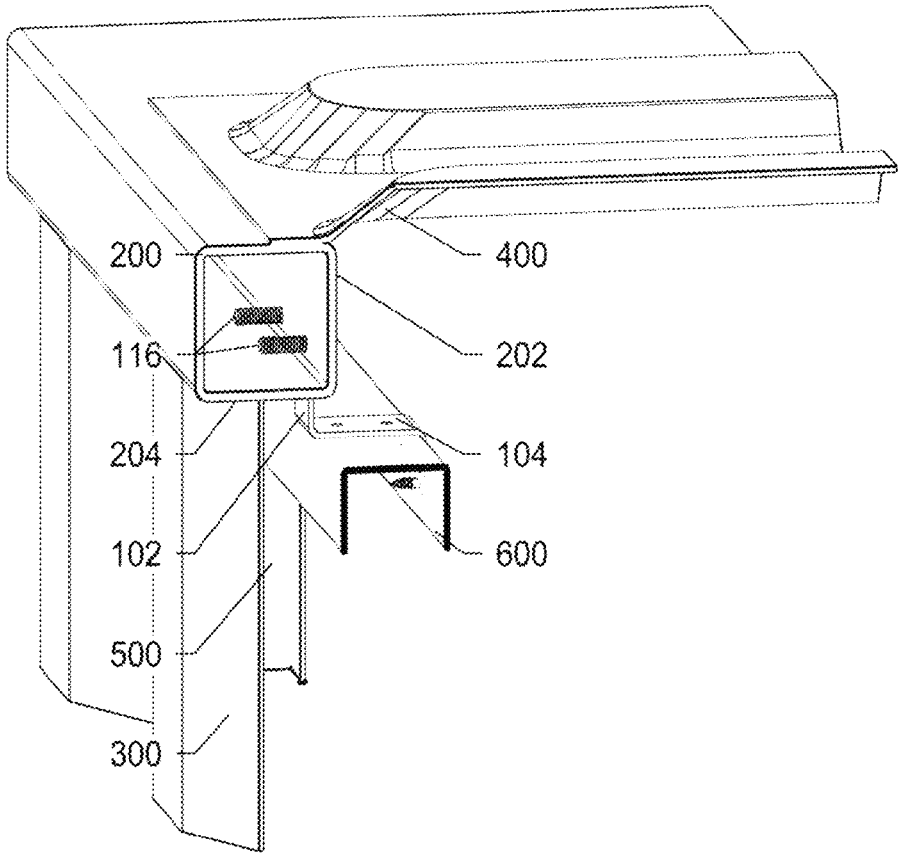
FIG. 4B is an installed view of an exemplary bracket.

FIGS. 4A and 4B together provide a mounting view of the bracket 100 on top of hollow tubing with vertical portion 102. FIG. 4B shows the vertical portion 102 installed on hollow tube front surface 202 using bolts, screws, rivets or other suitable fasteners 116 at the apertures 108 without penetrating the building envelope. By separating the framing members from the exterior side walls 300 and ceiling 400, it creates space for the vapor barrier between the container's walls and the interior framing.

Figure 5:
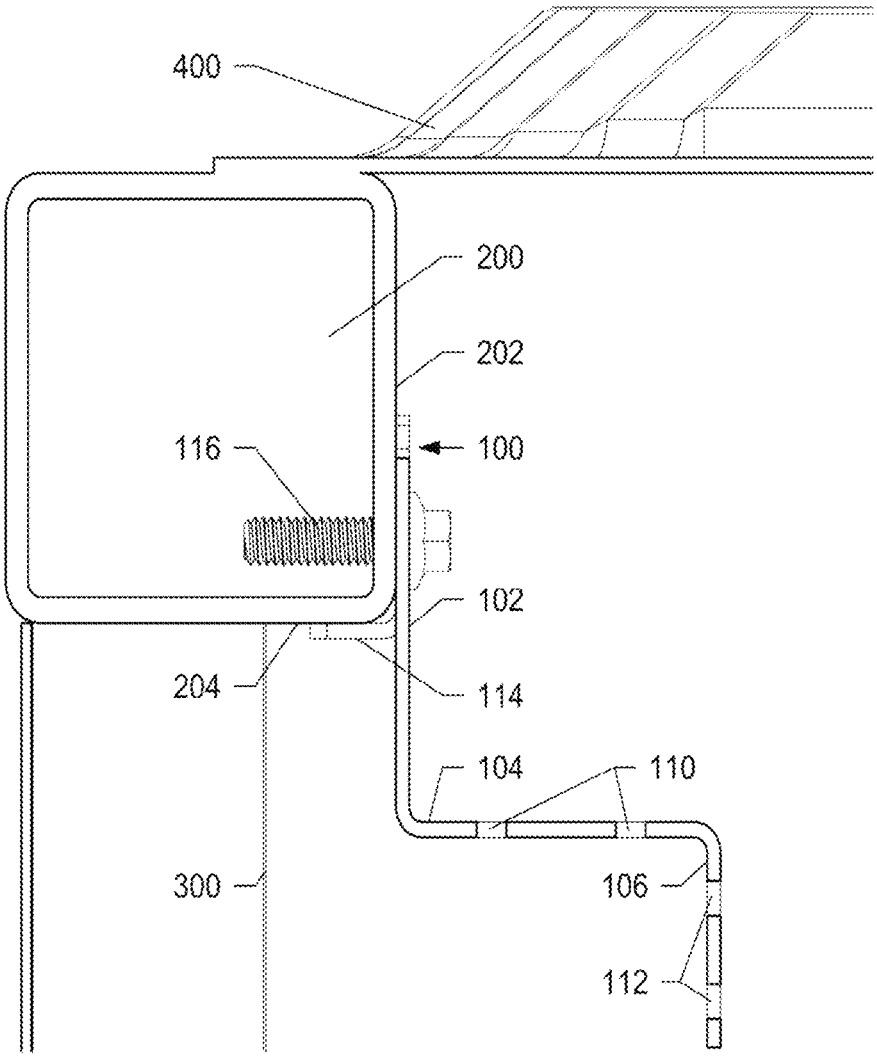
FIG. 5 is a cross-sectional view of the embodiment of FIG. 2 after installation on hollow top tubing of a shipping container.

FIG. 5 provides a cross-sectional view of the bracket 100 mounted on the front surface 202 of the top tubing 200 with vertical portion 102 and rearward tabs 114 touching the bottom surface 204 of top hollow tube 200.

Figure 6A:
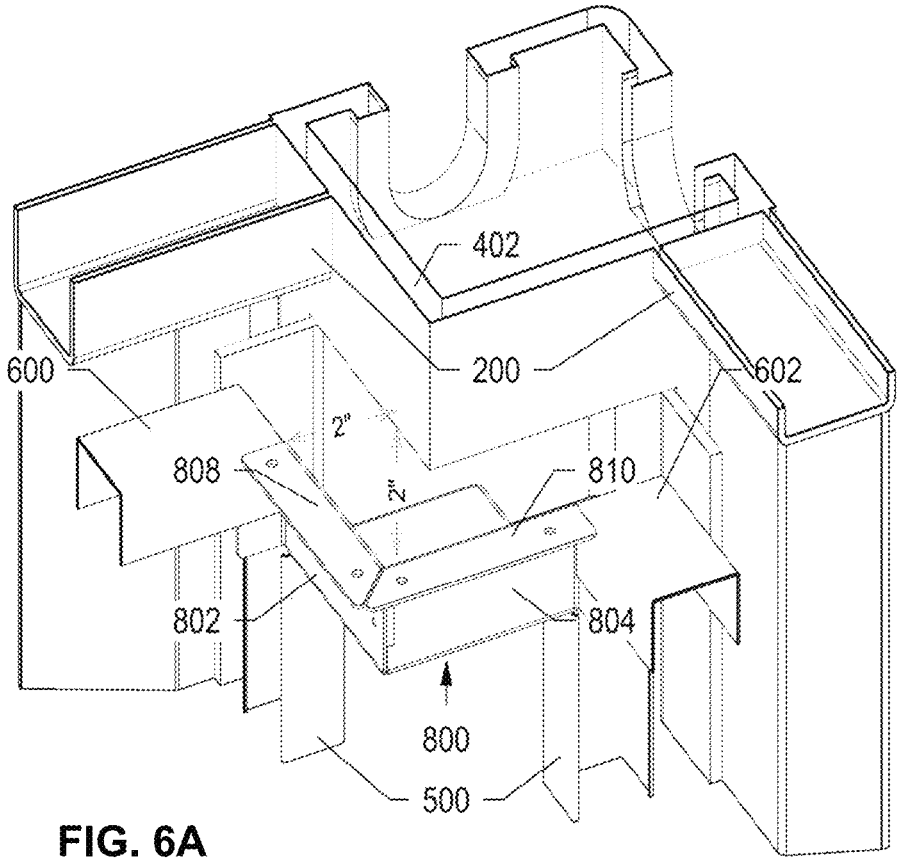
FIGS. 6A and 6B are detailed views of corner casting covers according to an exemplary embodiment attached on an end wall top corner of a shipping container.
Figure 6B:
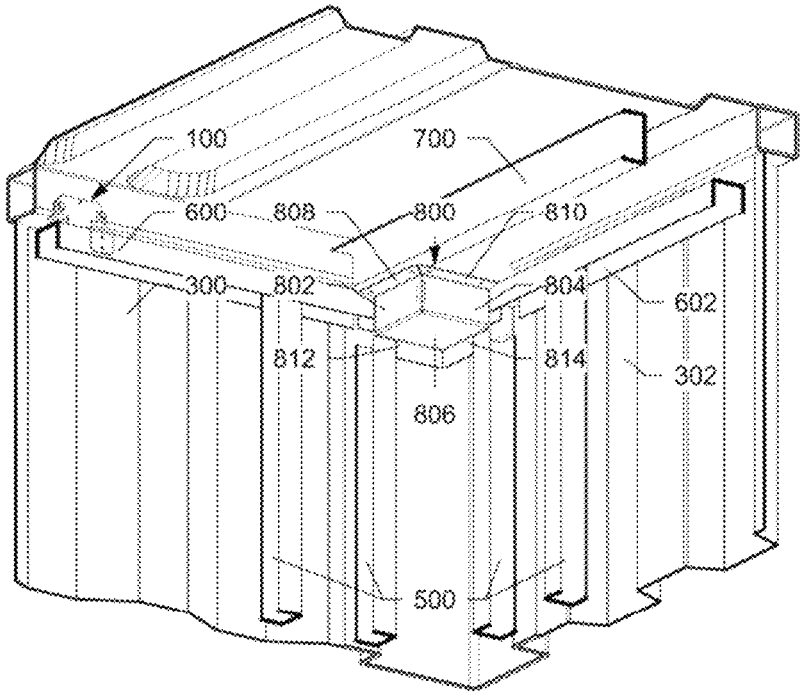

FIGS. 6A and 6B illustrate a detailed view of a corner casting cover 800. This component defines the end wall plane and provides space for a vapor barrier around the end wall corner castings. The side wall tracks 600 are inserted on the flange 808 of the side wall 802 and end wall tracks 602 inserted on the flange 810 of the other side wall 804. The side wall steel studs are attached on the flange 812 of the bottom surface 806 and end wall studs are inserted on the flange 814 of the bottom surface 806 of the corner casting cover.

Figure 7:
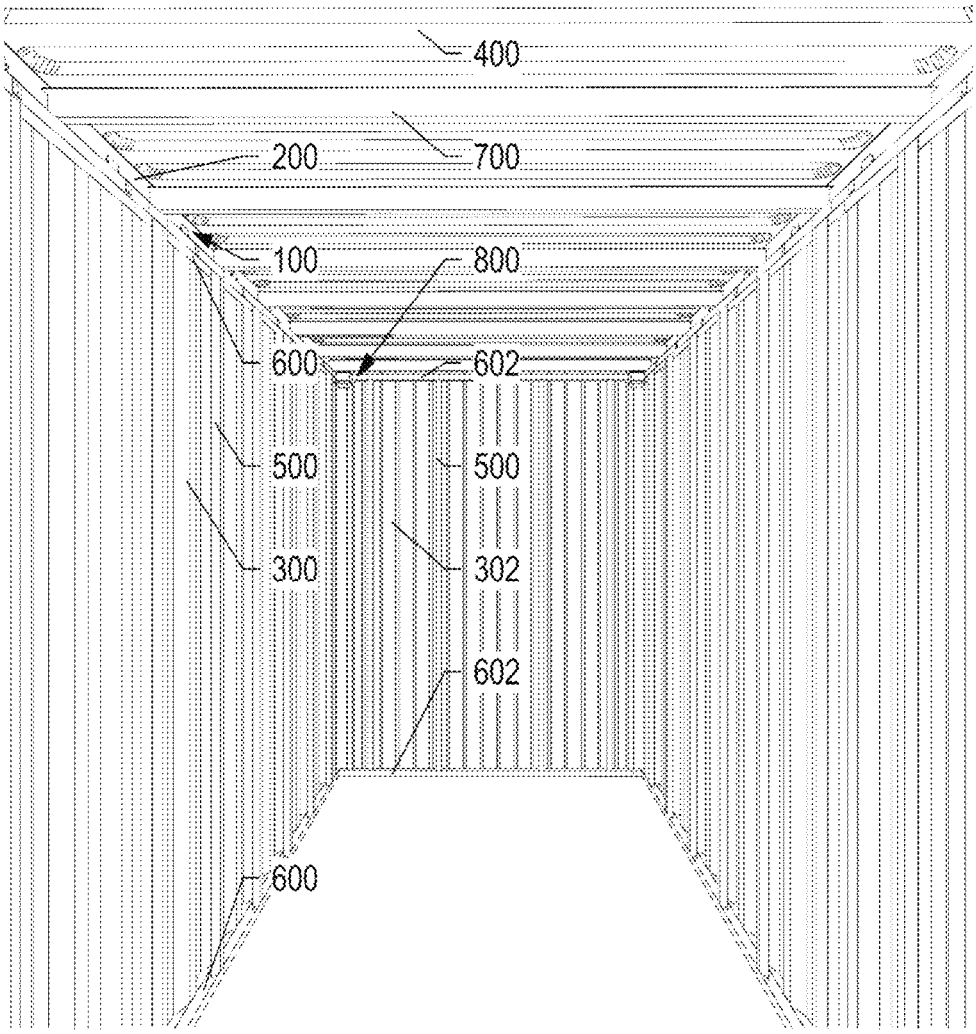
FIG. 7 is a perspective view of a shipping container installed with multiple brackets, tracks, studs and corner casting covers according to an exemplary embodiment.

FIG. 7 provides a detailed view of a shipping container which comprises two laterally extending top tubing 200 connecting the container's roof panel 400 and side wall 300, laterally spaced brackets 100 which are mounted on top tubing 200, steel studs 500, side wall tracks 600, corner casting cover 800, end wall tracks 602, and ceiling studs 700.

Turning now to FIGS. 8 to 14, exemplary brackets for use with a shipping container end wall are illustrated. There are two types of exemplary end wall brackets which may be installed on the end wall top tubing of the shipping container.

Figure 8:
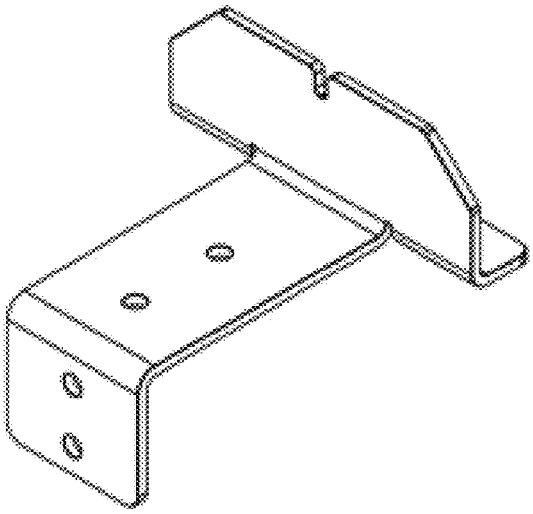
FIG. 8 is a front perspective view of an exemplary end wall bracket according to an embodiment of the present invention.
Figure 9:
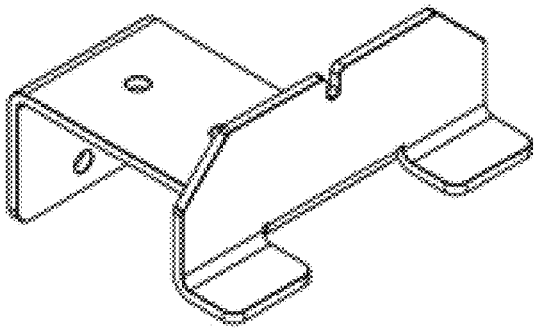
FIG. 9 is a rear perspective view of the embodiment of FIG. 8.
Figure 10:
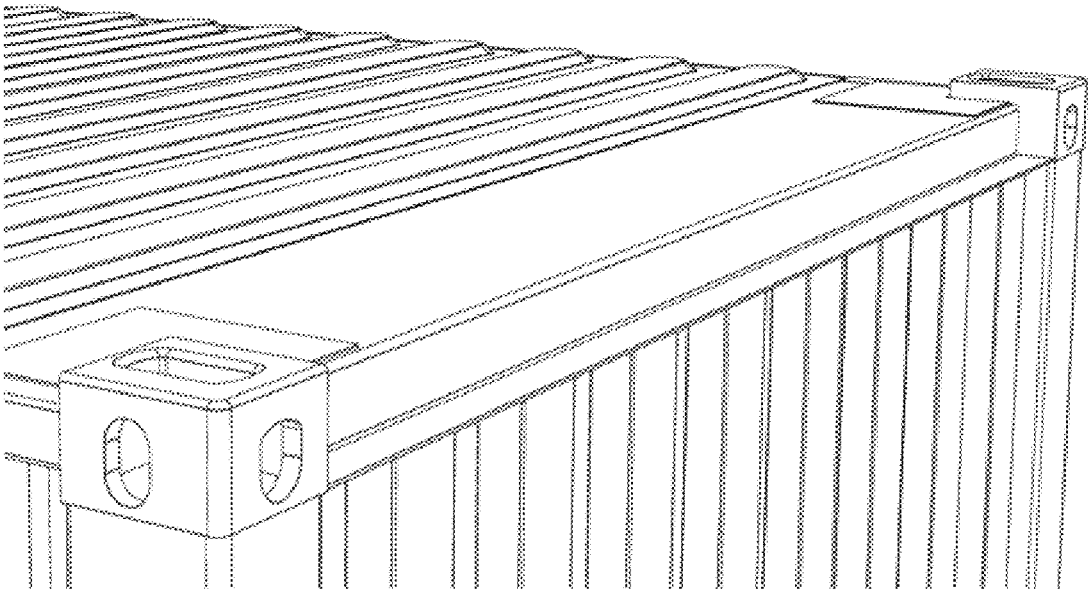
FIG. 10 is a top perspective view of an installation of the embodiment of FIG. 8.
Figure 11:
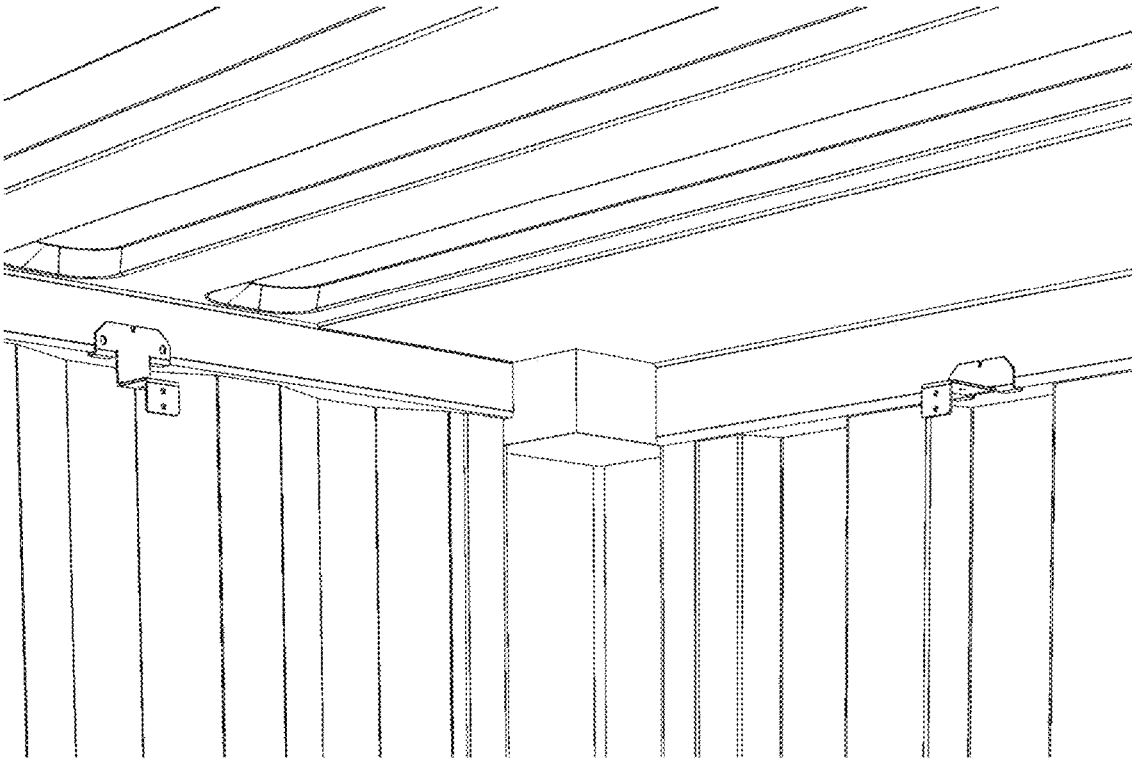
FIG. 11 is a rear perspective view of an installation of the embodiment of FIG. 8.

The first type of exemplary end wall bracket is illustrated in FIGS. 8, 9 and 10. The bracket design shown in FIGS. 8 and 9 has no holes on the vertical portion and can be mounted on the top tubing of the sidewall with the help of adhesives. Alternatively, the bracket illustrated in FIG. 10 can be used for end walls made with L-angle pieces and the bracket will not penetrate through the L-angle piece.

This type of end wall bracket will define the end wall plane similar to what is described above with regards to the side wall plane. It may be designed in a way that it will be in the same plane as the side wall bracket after installation.

Figure 12:
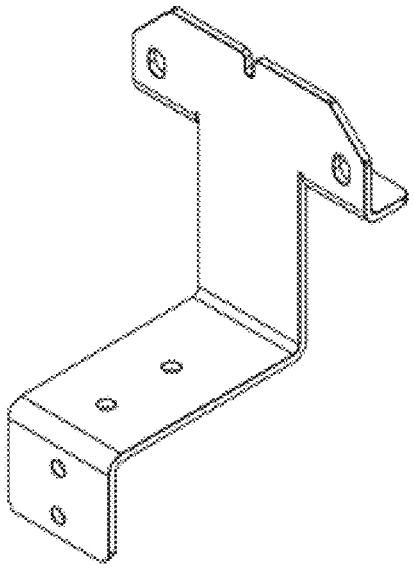
FIG. 12 is a front perspective view of another exemplary end wall bracket embodiment.
Figure 13:
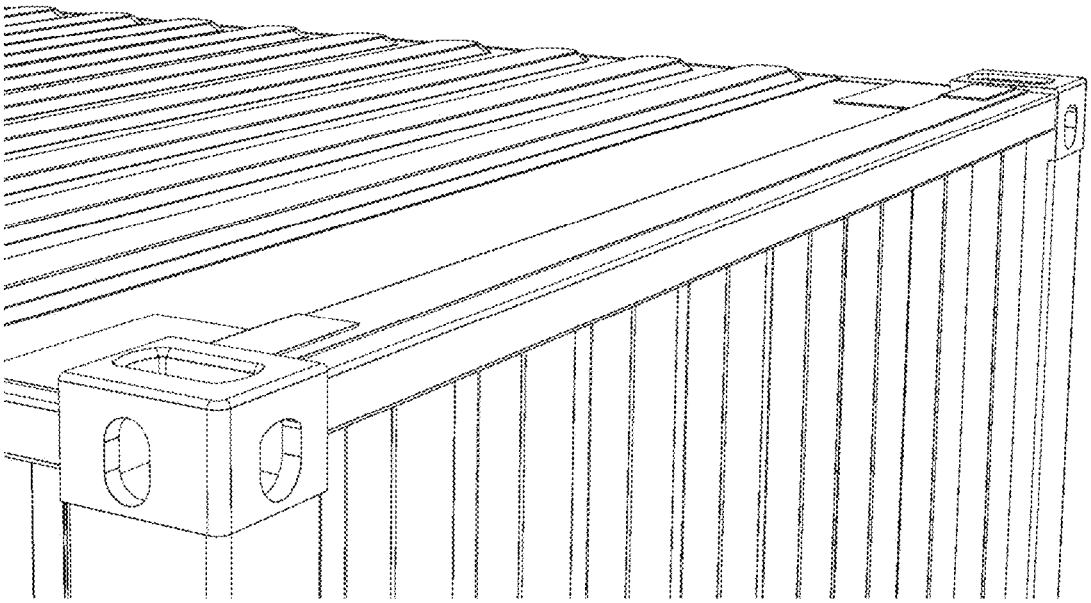
FIG. 13 is a top perspective view of an installation of the embodiment of FIG. 12.
Figure 14:
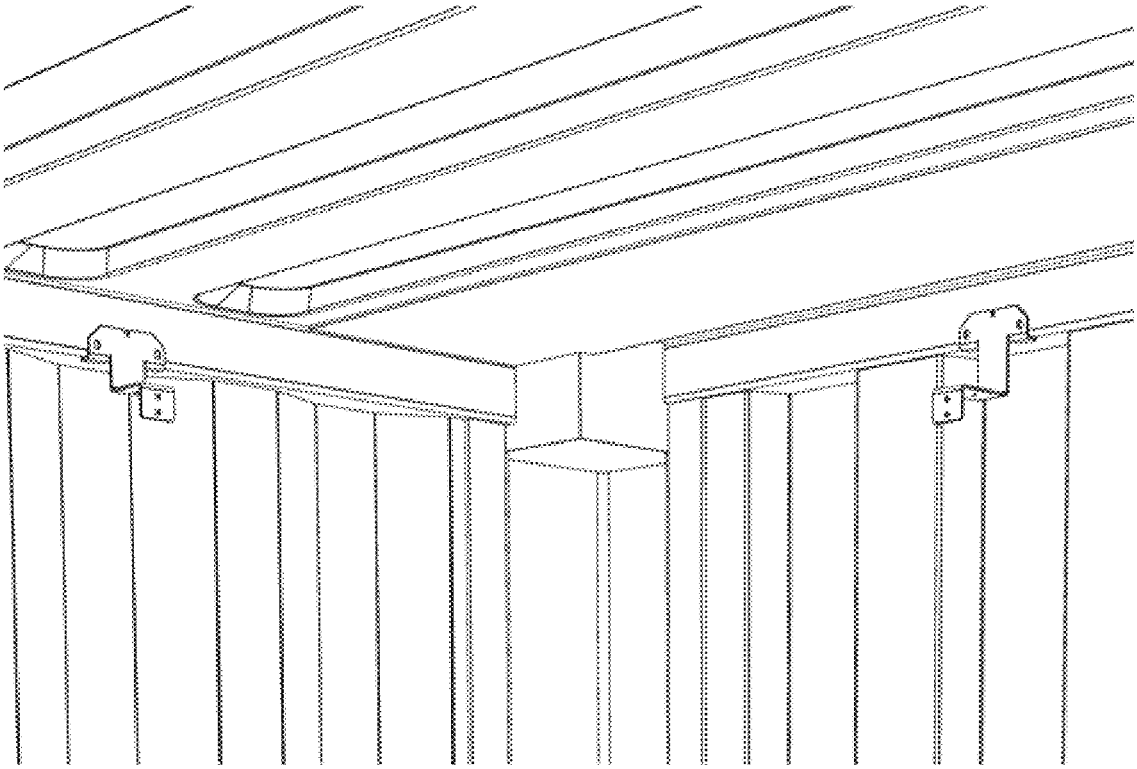
FIG. 14 is a bottom perspective view of an installation of the embodiment of FIG. 12.

The second type of exemplary end wall bracket is illustrated in FIGS. 12, 13 and 14. In the design illustrated in FIG. 12, the vertical height of the top portion has been increased and thus can be mounted on the top tubing of the sidewall with the help of adhesives. In the design illustrated in FIG. 13, the bracket can be used for end walls made with square top tubing and the bracket will not penetrate through square tubing. Finally, in the design illustrated in FIG. 14, this end wall bracket will define the end wall plane similar to the side wall plane. It is designed in a way that it will be in the same plane as the side wall bracket after installation.

Turning now to FIG. 15A to 15G, an exemplary embodiment of a bracket 900 suitable for retaining the ends of wood studs is illustrated. Where it is desirable to use wood studs within the shipping container interior space, such as for one non-limiting example a length of 2 inch×4 inch wood as a ceiling beam, a modified bracket 900 according to an embodiment of the present invention may be employed. The bracket 900 comprises a vertical mounting member 902 and alignment tabs 904, similar in many respects to the embodiments described above. The vertical mounting member 902 comprises holes 912 to allow the bracket 900 to be secured to the hollow tubing, while the alignment tabs 904 abut the bottom of the hollow tubing. The bracket 900, however, further comprises a vertical extension 906 on which upper and lower securing members 908, 910 are mounted. The upper securing member 908 can be used to receive and secure a wood stud therein using holes 914, or the lower securing member 910 can be used to receive and secure the wood stud therein using the holes 914, depending on the height at which the wood stud is desired to be positioned relative to the bracket 900. The wood stud can be retained either fully abutting the vertical mounting member 902, or a space may be left between the end of the wood stud and the vertical mounting member 902 (for example to allow injection of insulating foam).

The foregoing is considered as illustrative only of the principles of the present invention. The scope of the claims should not be limited by the exemplary embodiments set forth in the foregoing, but should be given the broadest interpretation consistent with the specification as a whole.

What is claimed is:

1. A bracket for use in supporting framing members for framing an interior space of a shipping container, the shipping container comprising walls with a plurality of corrugation recesses and hollow tubing extending along upper surfaces of the walls, the bracket comprising:

a vertical engagement surface configured for engagement with an inward-facing vertical side surface of the hollow tubing;

a horizontal engagement surface adjacent the vertical engagement surface and configured for simultaneous engagement with a downward-facing horizontal bottom surface of the hollow tubing and non-engagement with a corrugation recess of the plurality of corrugation recesses; and either or both of the vertical engagement surface and the horizontal engagement surface configured for securing to the hollow tubing at any point along the hollow tubing.

2. The bracket of claim 1 further comprising a horizontal extension configured to extend inwardly into the interior space to space the framing members from the walls.

3. The bracket of claim 2 wherein the horizontal extension comprises at least one aperture for securing one of the framing members thereto.

4. The bracket of claim 1 further comprising a vertical extension extending downwardly for providing an inwardly-facing surface for mounting one of the framing members thereto.

5. The bracket of claim 4 wherein the vertical extension comprises at least one aperture for securing one of the framing members thereto.

6. The bracket of claim 1 wherein the vertical engagement surface is configured for the securing to the hollow tubing and comprises at least one aperture for passage therethrough of securing means to secure the bracket to the hollow tubing.

7. The bracket of claim 6 wherein the securing means are of a length sufficient to pass into an interior of the hollow tubing but insufficient to pass completely through the hollow tubing.

8. The bracket of claim 1 wherein the horizontal engagement surface is composed of at least two alignment tabs.

9. The bracket of claim 1 further comprising a wood stud support member configured to receive an end of a wood stud therein.

10. The bracket of claim 1 wherein the bracket is composed of a material selected from the group consisting of steel, aluminum, and plastic.

11. A system for framing an interior space of a shipping container, the shipping container comprising walls with a plurality of corrugation recesses and hollow tubing extending along upper surfaces of the walls, the system comprising:

at least two brackets, each of the brackets comprising:

a vertical engagement surface configured for engagement with an inward-facing vertical side surface of the hollow tubing;

a horizontal engagement surface adjacent the vertical engagement surface and configured for simultaneous engagement with a downward-facing horizontal bottom surface of the hollow tubing and non-engagement with a corrugation recess of the plurality of corrugation recesses; and either or both of the vertical engagement surface and the horizontal engagement surface configured for securing to the hollow tubing at any point along the hollow tubing, such that the at least two brackets are in spaced-apart relation along the hollow tubing; and a framing member engaged with each of the at least two brackets.

12. The system of claim 11 wherein at least one of the at least two brackets further comprises a horizontal extension configured to extend inwardly into the interior space to space the framing member from the walls.

13. The system of claim 12 wherein the horizontal extension comprises at least one aperture for securing the framing member thereto.

14. The system of claim 11 wherein at least one of the at least two brackets further comprises a vertical extension extending downwardly for providing an inwardly-facing surface for mounting the framing member thereto.

15. The system of claim 14 wherein the vertical extension comprises at least one aperture for securing the framing member thereto.

16. The system of claim 11 wherein the vertical engagement surface is configured for the securing to the hollow tubing and comprises at least one aperture for passage therethrough of securing means to secure the bracket to the hollow tubing.

17. The system of claim 16 wherein the securing means are of a length sufficient to pass into an interior of the hollow tubing but insufficient to pass completely through the hollow tubing.

18. The system of claim 11 wherein the horizontal engagement surface is composed of at least two alignment tabs.

19. The system of claim 11 wherein at least one of the at least two brackets further comprises a wood stud support member configured to receive an end of a wood stud therein.

20. The system of claim 11 wherein at least one of the at least two brackets is composed of a material selected from the group consisting of steel, aluminum, and plastic.

21. A kit of parts for framing an interior space of a shipping container, the shipping container comprising walls with a plurality of corrugation recesses and hollow tubing extending along upper surfaces of the walls, the kit of parts comprising:

at least two brackets, each of the brackets comprising:

a vertical engagement surface configured for engagement with an inward-facing vertical side surface of the hollow tubing;

a horizontal engagement surface adjacent the vertical engagement surface and configured for simultaneous engagement with a downward-facing horizontal bottom surface of the hollow tubing and non-engagement with a corrugation recess of the plurality of corrugation recesses; and either or both of the vertical engagement surface and the horizontal engagement surface configured for securing to the hollow tubing at any point along the hollow tubing, such that the at least two brackets are in spaced-apart relation along the hollow tubing; and a framing member configured for engagement with each of the at least two brackets.

22. The kit of parts of claim 21 wherein at least one of the at least two brackets further comprises a horizontal extension configured to extend inwardly into the interior space to space the framing member from the walls.

23. The kit of parts of claim 21 wherein at least one of the at least two brackets further comprises a vertical extension extending downwardly for providing an inwardly-facing surface for mounting the framing member thereto.

24. The kit of parts of claim 23 wherein the vertical extension comprises at least one aperture for securing the framing member thereto.

25. The kit of parts of claim 22 wherein the horizontal extension comprises at least one aperture for securing the framing member thereto.

26. The kit of parts of claim 21 wherein the vertical engagement surface is configured for the securing to the hollow tubing and comprises at least one aperture for passage therethrough of securing means to secure the bracket to the hollow tubing.

27. The kit of parts of claim 26 wherein the securing means are of a length sufficient to pass into an interior of the hollow tubing but insufficient to pass completely through the hollow tubing.

28. The kit of parts of claim 21 wherein the horizontal engagement surface is composed of at least two alignment tabs.

29. The kit of parts of claim 21 wherein at least one of the at least two brackets further comprises a wood stud support member configured to receive an end of a wood stud therein.

30. The kit of parts of claim 21 wherein at least one of the at least two brackets is composed of a material selected from the group consisting of steel, aluminum, and plastic.

* * * * *